US007395748B2

(12) United States Patent
Krimbacher

(10) Patent No.: US 7,395,748 B2
(45) Date of Patent: Jul. 8, 2008

(54) HYDRAULIC DRIVE FOR DISPLACING AN ACTUATOR

(75) Inventor: Norbert Krimbacher, Feldkirch-Nofels (AT)

(73) Assignee: Linz Center of Mechatronics GmbH, Linz (AT)

( * ) Notice: Subject to any disclaimer, the term of this patent is extended or adjusted under 35 U.S.C. 154(b) by 258 days.

(21) Appl. No.: 10/560,227

(22) PCT Filed: Jun. 14, 2004

(86) PCT No.: PCT/AT2004/000202

§ 371 (c)(1),
(2), (4) Date: Dec. 12, 2005

(87) PCT Pub. No.: WO2004/111468

PCT Pub. Date: Dec. 23, 2004

(65) Prior Publication Data

US 2006/0137336 A1 Jun. 29, 2006

(30) Foreign Application Priority Data

Jun. 12, 2003 (AT) ..... A 913/2003

(51) Int. Cl.
*F15B 15/22* (2006.01)

(52) U.S. Cl. ..... 92/85 B; 60/415

(58) Field of Classification Search ..... 92/85 R, 92/85 B, 143; 60/413, 415; 91/276
See application file for complete search history.

(56) References Cited

U.S. PATENT DOCUMENTS 3,238,850 A * 3/1966 Desmarchelier ..... 91/394
3,805,672 A * 4/1974 Pekrul ..... 92/85 B
5,353,594 A * 10/1994 Yamashita et al. ..... 91/417 R
6,220,588 B1 * 4/2001 Tunkers ..... 269/32

FOREIGN PATENT DOCUMENTS

| | | |
|---|---|---|
| DE | 4233115 | 4/1994 |
| DE | 4242601 | 6/1994 |
| DE | 19602390 | 8/1996 |
| DE | 29811901 | 10/1998 |
| EP | 1215369 | 6/2002 |

OTHER PUBLICATIONS

International Search Report.

* cited by examiner

*Primary Examiner*—Michael Leslie
(74) *Attorney, Agent, or Firm*—Collard & Roe, P.C.

(57) ABSTRACT

A hydraulic drive is described for displacing an actuator (7) between two predetermined end positions, comprising a piston unit (4) which can be pressurized in a cylinder unit (3) in opposite directions by way of hydraulic springs and a control device for alternating pressurization in opposite directions of the piston unit (4). In order to provide advantageous constructional conditions it is proposed that the cylinder unit (3) comprises an end section (10) of smaller cross section than the remaining cylinder space (9) and receives in a sealing manner the respective face side (12) of the piston unit (4) in the associated end position, that the end sections (10) connected via a throttle (13) to a return line (14) for the hydraulic medium are delimited by a control edge (11) each relative to the remaining cylinder space (9), and that the control device consists of an actuating drive (28) for an axial relative movement of the control edge (11) relative to the face side (12) of the piston. (FIG. 1)

4 Claims, 3 Drawing Sheets

HYDRAULIC DRIVE FOR DISPLACING AN ACTUATOR

CROSS REFERENCE TO RELATED APPLICATIONS

Applicant claims priority under 35 U.S.C. §119 of Austrian Application No. A913/2003 filed on Jun. 12, 2003. Applicant also claims priority under 35 U.S.C. §365 of PCT/AT2004/000202 filed on Jun. 14, 2004. The international application under PCT article 21(2)was not published in English.

BACKGROUND OF THE INVENTION

1. Field of the Invention

The invention relates to a hydraulic drive for displacing an actuator between two predetermined end positions, comprising a piston unit which can be pressurized in a cylinder unit in opposite directions by way of hydraulic springs and a control device for alternating pressurization in opposite directions of the piston unit.

2. Description of the Prior Art

In order to enable the use of the energy applied via a hydraulic drive for opening a valve of an internal combustion engine also for closing the valve it is known (EP 1 215 369 A2) to use the compressibility of the hydraulic medium for forming two hydraulic springs for a pressurization in opposite directions of a piston, so that the energy applied via a hydraulic spring onto the piston is stored in the other hydraulic spring apart from frictional and leakage losses in order to be available for pressurizing the piston in opposite directions. The piston with the valve body to be driven thus forms a free oscillator in combination with the two hydraulic springs, which oscillator is held back or released in the two reversing positions by a control device. For this purpose, a control valve is used in a pressurization line joining the hydraulic spring with a pressure accumulator. The control valve is closed in the two end positions of the piston in order to move the piston, during the opening, via the respectively tensioned hydraulic spring under a tension of the other hydraulic spring to the opposite end position where the control valve is closed again for holding back the piston. Although actuators can be displaced with a comparatively low energy input between two end positions at high speed with the help of this known hydraulic drive, since it is merely necessary to compensate frictional and leakage losses, the movement of the actuator also depends on the switching speed of the control valve. Moreover, a separate control intervention is necessary for holding back the piston in the two reversing positions.

The invention is thus based on the object of improving a hydraulic drive of the kind mentioned above with simple constructional means in such a way that a movement of the actuator can be ensured which is independent of the actuating speed of the control device, and that for holding back the piston unit in the reversing positions no separate control intervention is required.

SUMMARY OF THE INVENTION

This object is achieved by the present invention in such a way that the cylinder unit comprises an end section of smaller cross section than the remaining cylinder space and receives in a sealing manner the respective face side of the piston unit in the associated end position, that the end sections connected with a throttle to a return line for the hydraulic medium are delimited by a control edge each relative to the remaining cylinder space and that the control device consists of an actuating drive for an axial relative movement of the control edge relative to the face side of the piston.

Since as a result of this measure the respective face side of the piston unit engages in its end position in the end section of the cylinder unit which is offset from the remaining cylinder space, the pressurization pressure on the face side of the piston engaging in the end section of the cylinder unit is omitted in this end section when the pressure is degraded in this end section accordingly, which is ensured via a return line for the hydraulic medium. This means that the piston unit engaging in the end position on the face side into the end section of the cylinder space is pressurized merely from the opposite face side and is therefore held in this end position although the cylinder space is subjected to a respectively high pressure. For triggering the piston unit in opposite directions it is necessary to connect the end section of the cylinder unit receiving the face side of the piston with the remaining cylinder space. For this purpose, the offset end section of the cylinder unit forms a control edge which needs to be axially displaced relative to the face side of the piston in order to pressurize the face side of the piston with the cylinder pressure. The hydraulic medium pressure which builds up suddenly in such a relative displacement of the face side of the piston relative to the control edge in the region of the end section of the cylinder space accelerates the piston unit against the opposite end position in which the piston unit is caught via the face side engaging in the end section there of the cylinder unit. Although the return line for the hydraulic medium which is connected to the end section comprises a throttle, the pressure can degrade accordingly in the end section of the cylinder space during the access of the face side of the piston. However, the throttle prevents a pressure degradation obstructing the acceleration of the piston unit during the sudden pressurization of the face side of the piston unit. Moreover, the return line for the hydraulic medium which is connected to the end section of the cylinder unit can be blocked additionally via a switch-over valve.

The control device for the hydraulic drive must produce an axial relative displacement between the face side of the piston and the control edge delimiting the end section of the cylinder unit. For this purpose, the control edge of the end sections of the cylinder unit can be formed on a sleeve which is held in an axially displaceable manner, is joined with the actuating drive of the control device and is displaced by the actuating drive of the control device. Once the control edge formed by the sleeve is moved past the face side of the piston, the pressurization of the piston unit occurs. The adjusting speed of the sleeve has no practical influence on the acceleration of the piston unit because the pressurization of the piston unit occurs suddenly with the release of the face side of the piston.

A further possibility to displace the face side of the piston relative to the control edge of the end section of the cylinder unit is to push against the piston unit in such a way that the face side of the piston is moved beyond the control edge which is fixed to the cylinder. For this purpose, the actuating drive of the control device can pressurize the face side of the piston engaging in the end section of the cylinder unit, which can be performed hydraulically, mechanically or electromagnetically.

If at least one face side of the piston unit is provided with a cross section which is differently large relative to the remaining piston unit, the pressure in the cylinder space can be used for holding in the end position or for releasing from the end position because the then graduated piston unit remains axially pressurized via the hydraulic medium even after the engagement of the face side in the end section of the cylinder space, which occurs independently of the pressurization of the opposite face side of the piston.

If the cylinder spaces pressurized with the hydraulic pressure medium form the hydraulic springs on both sides of the piston unit without falling back on the external pressure accumulators, then these pressure spaces must be joined with controllable pressurization lines in order to enable the compensation of frictional and leakage losses after each drive stroke. Since this control of the pressurization lines depends on the respective position of the piston unit, the pressurization lines can be opened and closed by control edges of the piston unit depending on the axial piston position, so that separate switch-over valves for this purpose, including the respective triggering, can be omitted. In a similar way it is possible to also control the return line for the hydraulic medium in the end sections of the cylinder unit with the help of a respective control edge of the piston unit.

BRIEF DESCRIPTION OF THE DRAWINGS

The subject matter of the invention is shown by way of example in the drawings, wherein.

DESCRIPTION OF THE PREFERRED EMBODIMENTS

Figure 1:
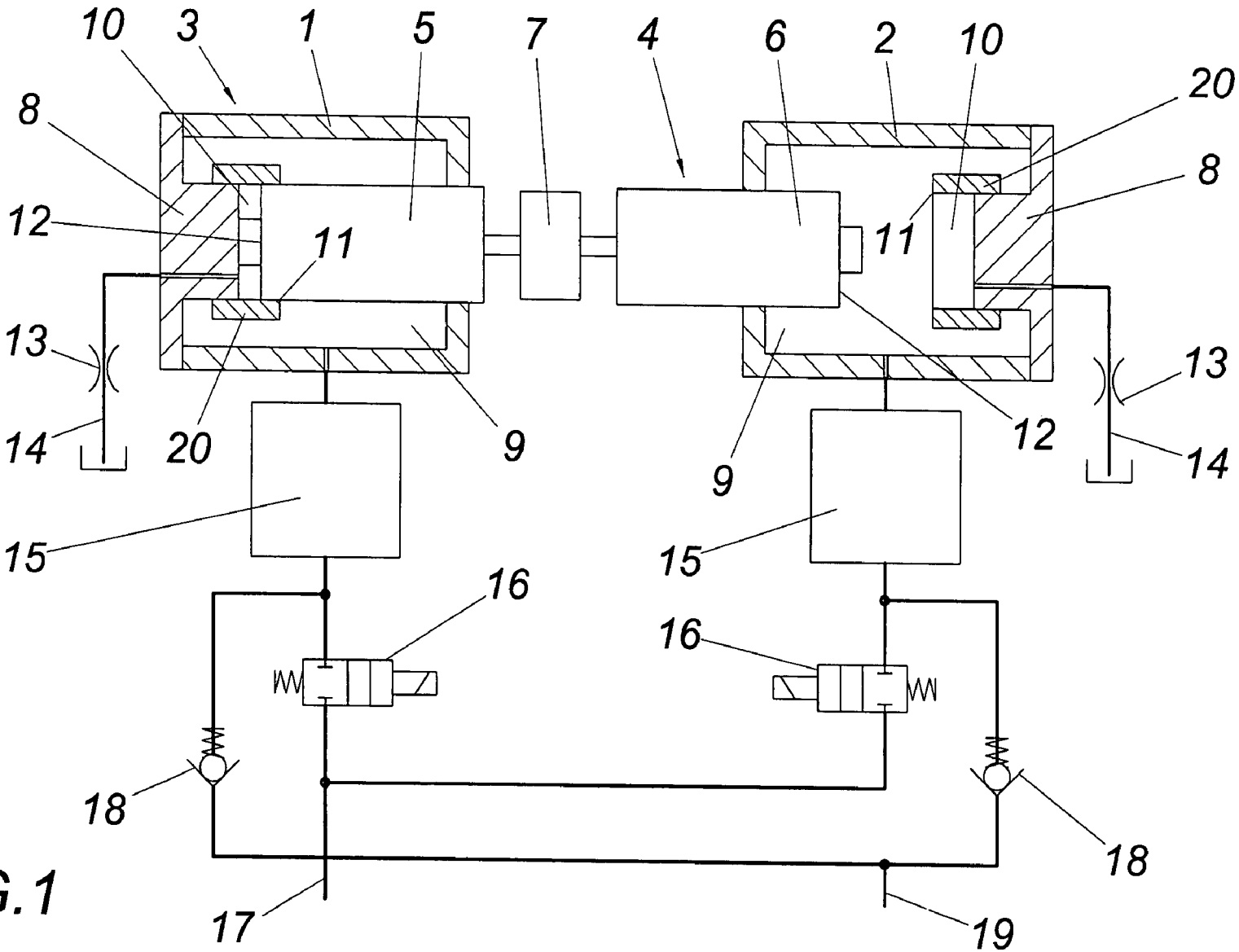
FIG. 1 shows a hydraulic drive in accordance with the invention for displacing an actuator in a simplified block diagram.

According to the block diagram of FIG. 1, the illustrated hydraulic drive comprises a cylinder unit 3 which is subdivided into two cylinder blocks 1 and 2 and whose piston unit 4 comprises two piston bodies 5 and 6 which cooperate with the cylinder blocks 1 and 2 and are joined by way of an actuator 7 adjustable between two end positions. The cylinder blocks 1 and 2 form end sections 10 which are offset from the remaining cylinder space 9 and are provided with a smaller cross section than the remaining cylinder space 9 in the region of their mutually averted face walls 8. Said end sections 10 are delimited relative to the remaining cylinder space 9 by a control edge 11 and receive the face side 12 of the respective piston bodies 5 and 6 in the respective end position of the piston unit 4. The end sections 10 of the cylinder blocks 1 and 2 are each connected via throttles 13 to a return line 14 for the hydraulic medium. The pressure spaces 9 of the cylinder blocks 1, 2 optionally form a hydraulic accumulator 15 with external additional accumulators which is shown as a block. Said hydraulic accumulators 15 represent hydraulic springs as a result of the compressibility of the hydraulic medium, by means of which the piston bodies 5 and 6 can be pressurized in opposite directions. The hydraulic accumulators 15 are connected via switch-over valves 16 to a pressure line 17. In addition, the hydraulic accumulators 15 are connected via non-return valves 18 with a pressure line 19 which ensures a predetermined minimum pressure for the hydraulic accumulator 15.

In the end position of the piston unit 4 as shown in FIG. 1, the piston body 5 engages in the end section 10 of the cylinder block 1 in a sealing manner with its face side 12, so that the hydraulic medium pressure prevailing in the pressure chamber 9 of the cylinder block 1 cannot exert any axial pressure forces on the piston unit 4, which is thus kept in this end position by the pressurization pressure in the region of the cylinder block 2. In order to pressurize the piston body 5 with the hydraulic medium pressure in the cylinder chamber 9 it is necessary to hydraulically join the end section 10 with the remaining cylinder space 9. For this purpose, the end section 10 is enclosed by a sleeve 20 which forms the control edge 11. This sleeve 20 is held in an axially displaceable way and can be axially displaced by means of an actuating drive of a control device relative to the face side 12 of the piston body 5 in order to release the face side 12, which upon the passage of the control edge 11 is suddenly subjected to the pressure of the hydraulic medium in the cylinder space 9 and accelerates the piston unit 4 with the actuator 7 against the pressure in the cylinder space 9 of the cylinder block 2. The throttle 13 in the return line 14 suppresses a respective pressure drop in the end section 10. With the relief of the hydraulic accumulator 15 of cylinder block 1, the hydraulic accumulator 15 of the cylinder block 2 is tensioned via the piston body 6 entering the cylinder space 9, with the face side 12 of the piston body 6 engaging in a sealing manner in the end section 10 of the cylinder block 2 in the region of the movement reversal of the free oscillator forming the end position of the piston unit 4. The piston unit is held in the new end position by the remaining pressure of the partly relieved hydraulic accumulator 15. The connection of the hydraulic accumulator 15 with the pressure line 19 via the non-return valves 18 secures a minimum holding pressure for the piston unit 4. The connection of the hydraulic accumulators 15 with the pressure line 19 via the non-return valves 18 secures a minimum holding pressure for the piston unit 4. By opening the associated switch-over valve 16, the hydraulic accumulator 15 can be loaded via a pressure line 17 to a predetermined system pressure for compensating frictional and leakage losses for the cylinder block 2 receiving the piston unit 4 in the end position, this being in order to make available, in case of a triggering of the cylinder block 2 via the sleeve 20, the full system pressure for pressurizing the piston body 6 against the pressure of the hydraulic accumulator 15 which is associated with the cylinder block 1 and is partly relieved. As has already been described in connection with the opposite piston body 6, the piston body 5 cooperating with the cylinder block 1 is held upon reaching the end position by the piston face side 12 relative to a free oscillating movement, which face side engages in the end section 10 of cylinder block 1 and is thus withdrawn from the pressurization pressure until it is released again by a renewed displacement of the sleeve 20. In the meantime, the hydraulic accumulator 15 which is associated with cylinder block 1 and is tensioned again by the return of the piston unit 4 can be connected to the pressure line 17 via the control valve 16 for covering the frictional and leakage losses, which control valve must be closed again via the control device provided for this purpose before the triggering of the sleeve 20.

Figure 2:
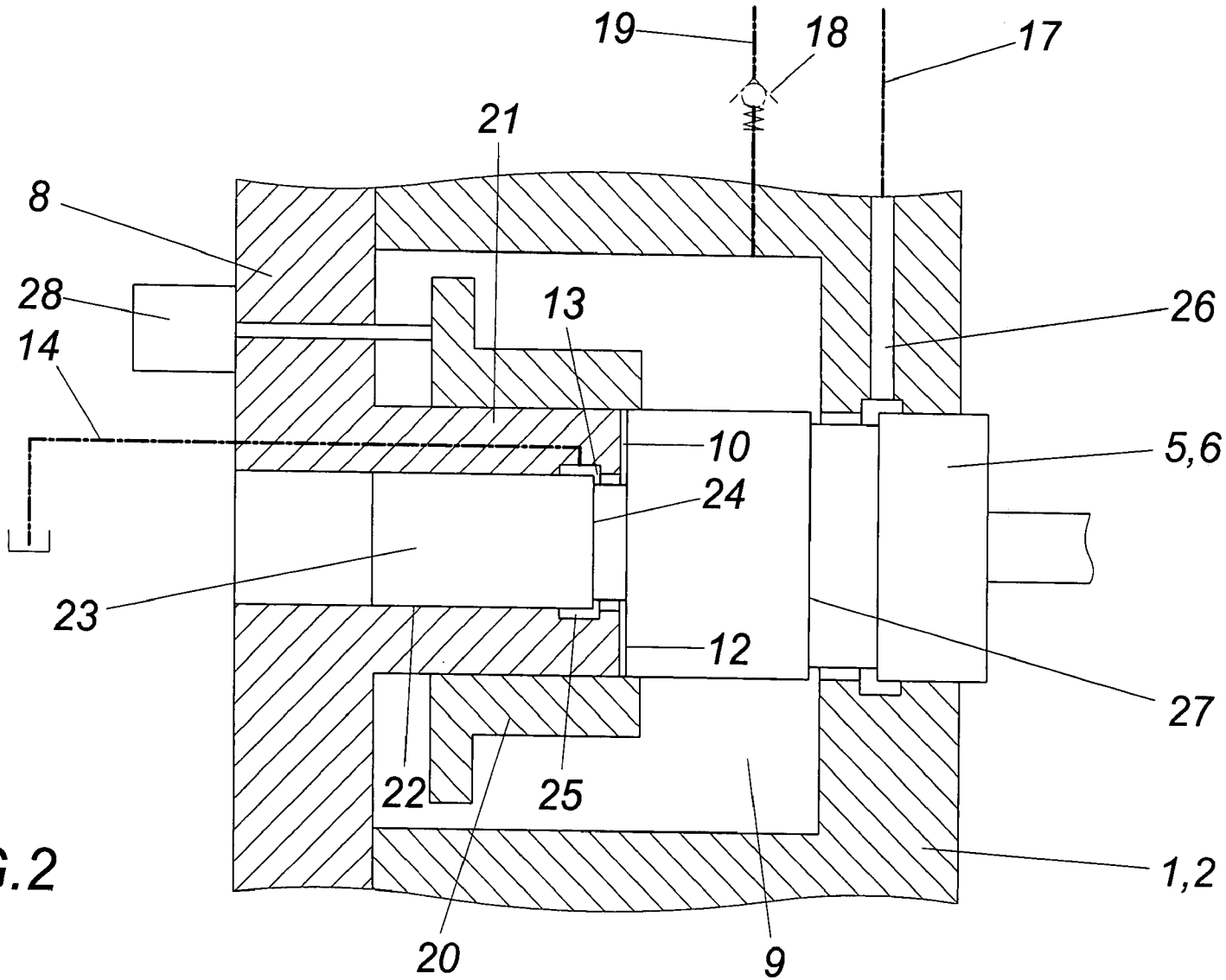
FIG. 2 shows a schematic axial sectional view of a cylinder space associated with one side of the piston unit.

FIG. 2 shows one of the two cylinder blocks 1, 2 of the cylinder unit 3 in closer detail, with the pressure chamber 9 forming the hydraulic accumulator which is relevant for the hydraulic spring. The face wall 8 comprises a coaxial projection 21 on which the sleeve 20 is held in an axial displaceable way, which sleeve is required for controlling the piston body 5, 6. Said projection is also provided with a receiving bore 22 for a guide projection 23 which projects beyond the face side 12 of the piston body 5, 6 and which comprises a control edge 24 for an annular connecting groove 25 of the return line 14. The throttling position arising in the illustrated end position of the piston body 5, 6 between the control edge 24 of the guide projection 23 and the connecting groove 25 is used as a throttle 13, as is indicated in the block diagram according to FIG. 1. As a result of this measure, the return line 14 is only opened for the engagement of the face side 12 of the piston body 5, 6 in the end section 10 of the cylinder blocks 1, 2, which thus prevents major leakage losses.

In a similar manner, the pressurization lines 26 for the pressure chambers 9 of the cylinder blocks 1, 2 can be opened and closed by control edges 27 of the piston bodies 5, 6 depending on the piston position. In the case of a hydraulic accumulator which is limited to the pressure chamber 9, said pressurization lines 26 are used for connecting the pressure chamber 9 with the pressure line 17, with the control edge 27 assuming the task of a switch-over valve. The connection of the pressure chamber 9 with the pressure line 19 which is subjected to only a partial pressure and comprises a non-return valve 18 does not require any control.

The sleeve 20 is pressurized by an actuating drive 28 which displaces the sleeve 20 hydraulically, mechanically or electromagnetically on the coaxial projection 21 of the cylinder block 1 or 2. Said actuating drive 28 does not need to be provided outside of the cylinder unit 3. Such actuating drives can also be built into the cylinder unit 3.

Figure 3:
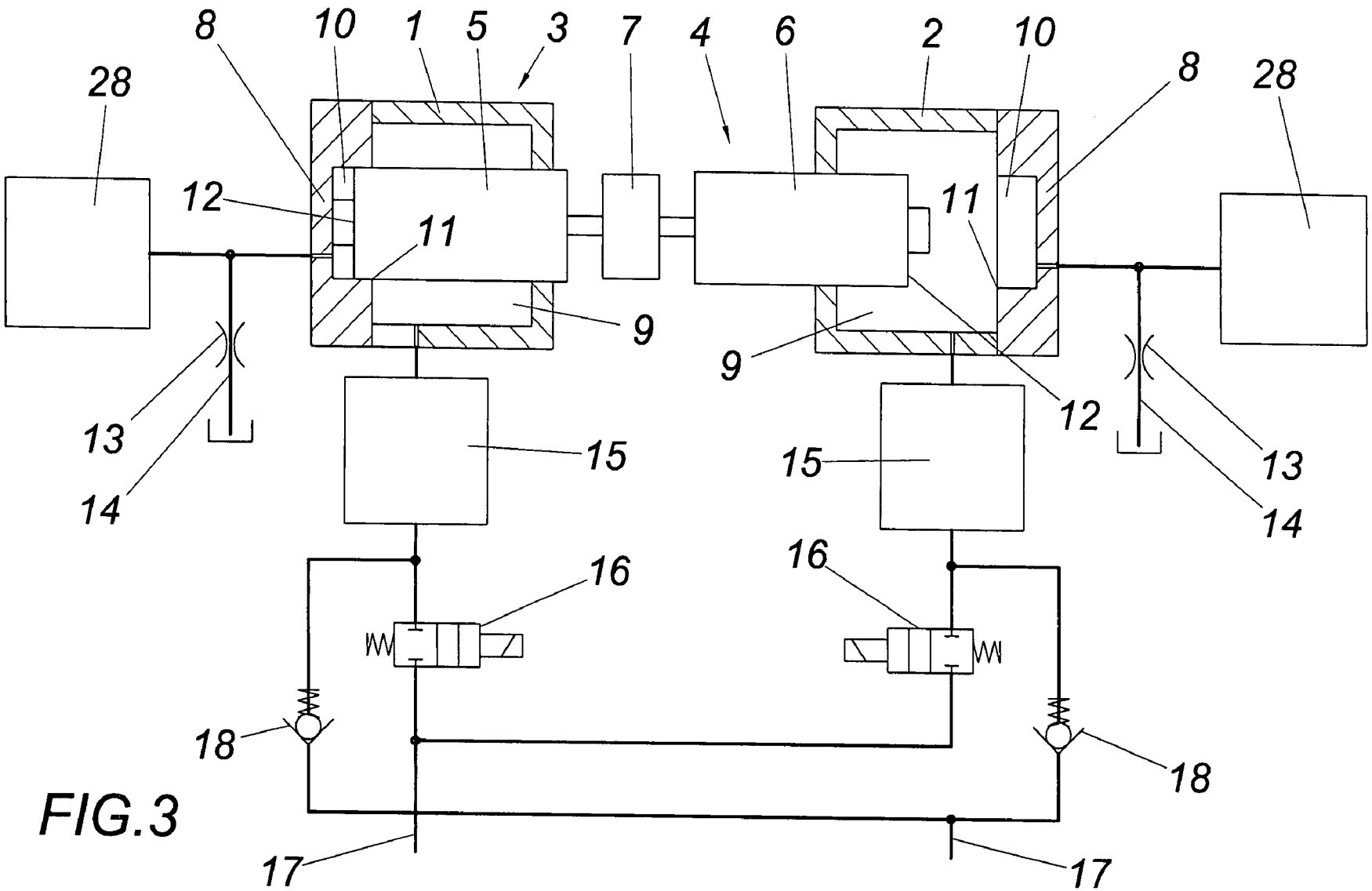
FIG. 3 shows a representation of a constructional variant according to FIG. 1 of a hydraulic drive in accordance with the invention.

The hydraulic drive according to FIG. 3 differs from the one according to FIG. 1 merely by the triggering of the piston bodies 5, 6. The end section 10 of the cylinder blocks 1, 2 with the control edge 11 is not formed by a movable sleeve, but by a recess in the face wall 8, so that for the purpose of the axial relative movement of the control edge 11 relative to the face side 12 of the piston body 5, 6 it is necessary to displace the same. For this purpose an actuating drive 28 is provided. It is used to pressurize the face side 12 of the piston body which engages in the end section 10 in order to push the piston body and to move the face side 12 beyond the control edge 11, so that the hydraulic pressure in the cylinder space 9 can be used for pressurizing the respective piston body 5, 6. Although this piston pressurization occurs hydraulically in the embodiment according to FIG. 3, the actuating drive can also push the respective piston body 5, 6 in a mechanical or electromagnetic manner. Apart from that, the hydraulic drive works like the one shown in FIG. 1. As a result of the tensioning and relaxation of the hydraulic accumulator 15 during the reciprocating movement of the piston unit 4, a large part of the energy used for displacing the actuating drive 7 in one direction is saved in order to be available for the return movement of the piston unit 4, so that merely the occurring frictional and leakage losses need to be compensated.

The described measures allow considerably reducing the energy consumption especially at high piston accelerations, which occurs at very short actuating times because it is only necessary to trigger the piston bodies 5, 6 accordingly and automatically lock into the respective end position. Hydraulic drives in accordance with the invention are consequently suitable for actuators with short switching times, as are required for example for switch-over and safety valves.

It is understood that the invention is not limited to the illustrated embodiments. Cylinder blocks 1, 2 could be combined into a common cylinder in which a single piston is held as a piston unit. In this case it is necessary to produce a drive connection in the form of a piston rod between the actuator and the piston unit. In order to influence the elasticity of the hydraulic springs, gas bubbles can be incorporated in the hydraulic medium or the hydraulic accumulator can be pressurized additionally by springs.

The invention claimed is:

1. A hydraulic drive for displacing an actuator between two predetermined end positions, which comprises (a) a cylinder unit comprising two separate cylinder chambers and an end section in each cylinder chamber, the end section having a smaller cross section than the cylinder chamber and being delimited from the cylinder chamber by a control edge, (b) a piston unit connected to the actuator and having a piston extending into each cylinder chamber and each end section receiving in a sealing manner an end face of a respective one of the pistons in a respective one of the end positions, (c) hydraulic springs alternatingly applying pressure to a respective one of the pistons for moving the piston unit in opposite directions, the hydraulic springs comprising a return line for a hydraulic medium connected via a throttle to a respective one of the end sections, and (d) a control device for alternatingly applying pressure to the respective piston, the control device consisting of an actuating drive for effectuating an axial repositioning of the control edge relative to the end face of the piston.

2. The hydraulic drive of claim 1, comprising an axially displaceable sleeve forming the control edge, the actuating drive being connected to the sleeve for axial movement of the control edge relative to the end face of the piston.

3. The hydraulic drive of claim 1, wherein the actuating drive is arranged to apply pressure to the end face of the piston for axial movement of the end face of the piston relative to the control edge.

4. The hydraulic drive of claim 1, further comprising control edges on each piston for controlling opening and closing the return line depending on the axial position of the piston.

* * * * *